US006039643A

United States Patent [19]

Kurosawa et al.

[11] Patent Number: 6,039,643

[45] Date of Patent: Mar. 21, 2000

[54] COIN DISTRIBUTOR

[75] Inventors: Motoharu Kurosawa; Hiroshi Abe, both of Iwatsuki, Japan

[73] Assignee: Asahi Seiko Kabushiki Kaisha, Japan

[21] Appl. No.: 09/256,576

[22] Filed: Feb. 24, 1999

[30] Foreign Application Priority Data

| | | | |
|---|---|---|---|
| Mar. 2, 1998 | [JP] | Japan | 10-090523 |
| Nov. 3, 1998 | [JP] | Japan | 10-349299 |
| Nov. 25, 1998 | [JP] | Japan | 10-375399 |

[51] Int. Cl.[7] ..... G07D 3/00

[52] U.S. Cl. ..... 453/3; 453/56

[58] Field of Search ..... 453/3, 4, 7, 11, 453/32, 56; 194/317, 318

[56] References Cited

U.S. PATENT DOCUMENTS

| | | | |
|---|---|---|---|
| 3,191,739 | 6/1965 | White, Jr. | 453/3 |
| 4,586,522 | 5/1986 | Taipale et al. . | |
| 5,538,468 | 7/1996 | Ristvedt et al. | 453/3 |
| 5,562,536 | 10/1996 | Uchida et al. | 354/9 |
| 5,624,308 | 4/1997 | Rumbach | 453/3 |

FOREIGN PATENT DOCUMENTS

| | | | |
|---|---|---|---|
| 2120231 | 8/1972 | France . | |
| 2650417 | 1/1991 | France . | |
| 2650417 | 2/1991 | France | 453/3 |
| 2513240 | 10/1976 | Germany | 453/7 |
| 3624346 | 1/1988 | Germany . | |
| 7-306965 | 11/1995 | Japan . | |
| 2121582 | 12/1983 | United Kingdom | 453/3 |

*Primary Examiner*—Christopher P. Ellis
*Assistant Examiner*—Thuy V. Tran
*Attorney, Agent, or Firm*—McGlew and Tuttle, P.C.

[57] ABSTRACT

Coin division equipment is provided which can be programmed for a shape which it is possible to physically store easily and operate with equipment such as a money register. The coin division equipment may be applied to many coin types in the various European, Asian, American countries etc. The equipment includes a cover with a low big circular board form, a slender ring for coin conveyance which is rotatably mounted along the outside periphery of bottom of the cover means; and coin passage. The passage has a ring-shaped inclination board form approximately, the outside perimeter thereof being high and the inside perimeter thereof being near the outside periphery of ring. The coin passage has a plurality of openings for coin division.

9 Claims, 10 Drawing Sheets

COIN DISTRIBUTOR

FIELD OF THE INVENTION

This invention relates to a coin distribution apparatus for dividing several kinds of currencies, i.e., coins, according to the various types of money. Especially, this invention relates to an apparatus for distinguishing several kinds of thrown coins respectively and distributing each coin according to the money type. This invention specifically relates to a coin distribution apparatus which contains each coin according to the money type and is suitable for an apparatus for preparing change and so on. In addition, the term "coin" which is used in the specification includes disc bodies such as currencies, medals, tokens, etc.

BACKGROUND OF THE INVENTION

Until this time, various apparatus for distributing coins have been developed. An example is disclosed in the specification of Japanese Patent Application 6-123019 filed by this Applicant. (Japanese Patent Application 6-123019 is opened as unexamined Japanese Patent Disclosure 7-306965, and is issued as U.S. Pat. No. 5,562,536.) This distribution apparatus is provided with means (83, etc.) to receive various coins loosely and to send out the coins one by one as shown in FIG. 10.

The apparatus is provided with a coin guide path (111*c*) where a plurality of openings (111*f*–111*k*) are formed along the periphery. In addition, a symbol 111 is a gauge means for coin selection having a coin guide path.

Furthermore, the apparatus is provided with conveying means (130, etc.) for moving the coin along the above-mentioned coin guide path.

SUMMARY AND OBJECTS OF THE INVENTION

It is an object of the invention to simplify the coin distribution apparatus and make the height of the entire apparatus low.

It is another object of the invention to advantageously arrange the coin detecting structure and the opening-closing device of the coin receiving hole of an undersurface coin path.

It is still another object of the invention to increase the types of money that can be distributed and make the distribution order of the various money types optional.

It is still a further object of the invention to provide a coin distribution apparatus of an optional shape which can be easily housed under apparatuses, such as under a money register.

It is still another object of the invention to provide a coin distribution apparatus which is enabled to apply to the various kinds of money (currencies of European, Asian, American countries etc.).

According to the invention, an apparatus for the distributing coins into coin kinds is provided with at least a cover of large disc type with a low height. A slender belt is provided for coin conveyance which is rotatably arranged along the outside periphery of the bottom of the cover. A coin path is provided with a plurality of open holes for coin distribution. The path is provided with an inclination board of substantially a ring shape, the outside periphery is high and the inside periphery approaches the outside periphery of the belt.

The invention also provides an apparatus for the distribution of coins into the coin kinds, wherein a device for opening-closing an open hole for coin distribution is arranged at the undersurface of the open hole. In addition, this invention provides an apparatus for the distributing of coins into the coin kinds, wherein the device for opening-closing the open hole is actuated by means for detecting coins.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
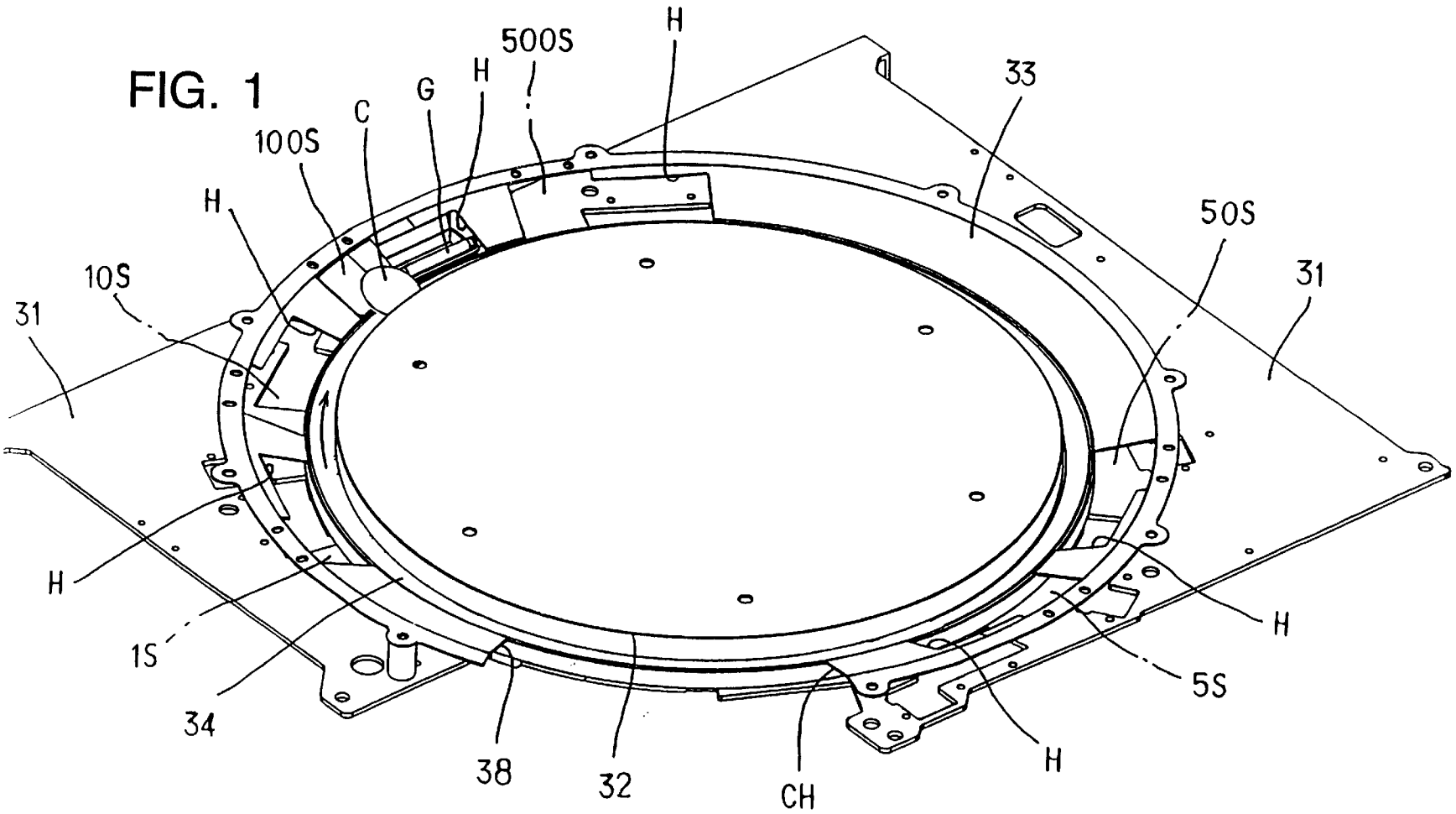
FIG. 1 is a perspective schematic view showing one embodiment according to this invention.
Figure 5:
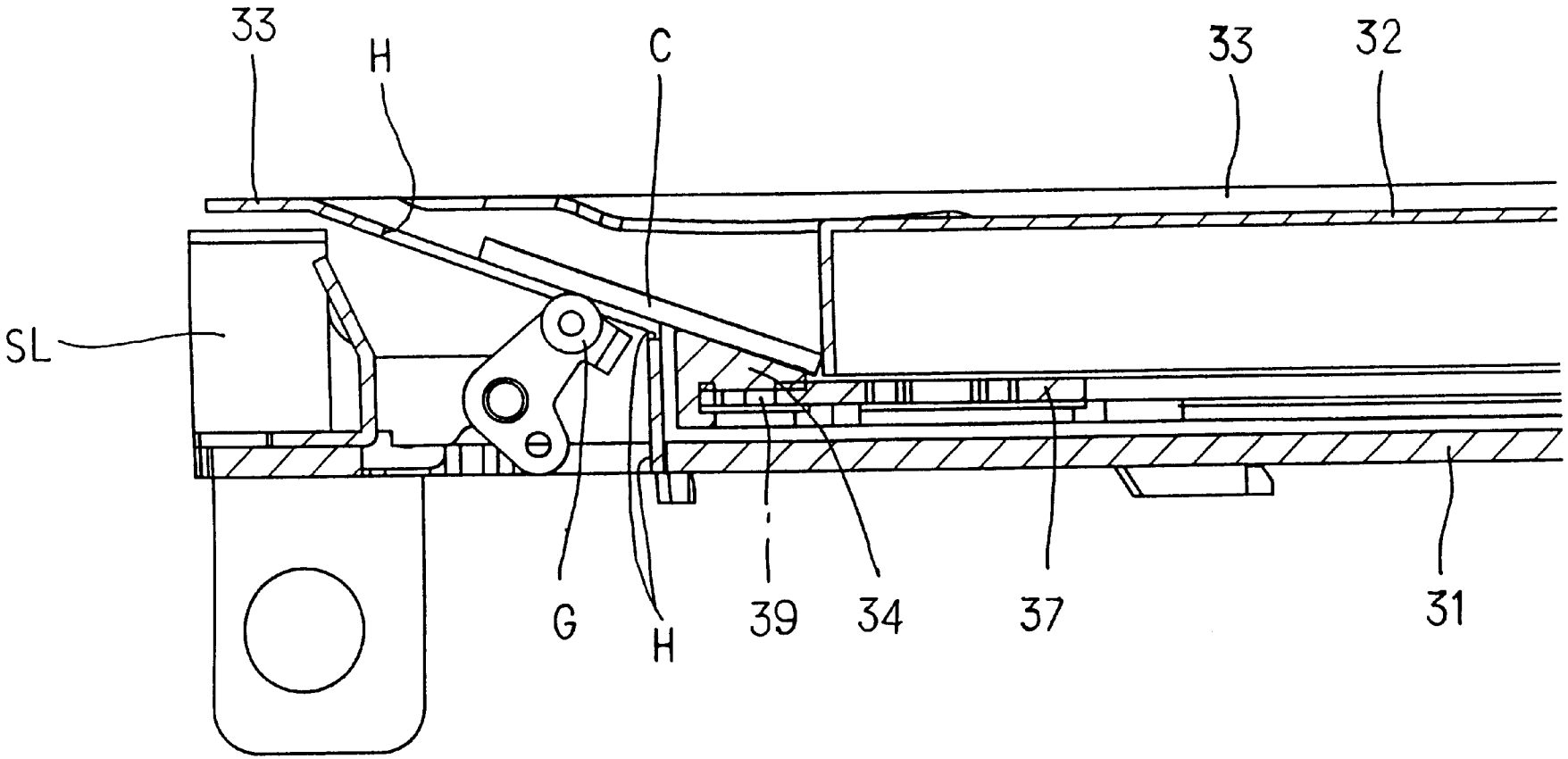
FIG. 5 is an expanded sectional view showing the other principal part of the embodiment of FIG. 1 from the front.

Referring to the drawings in particular, the invention provides a money distribution apparatus for a plurality of coins shown in FIG. 1 with a large rectangle base board 31. A fairly large and low height circular cover board 32 is fixed by a screw stop on the center of the base board 31. At the periphery of the circular cover board 32, a path board 33 of circle ring type is fixed to the base board 31 by a screw stop. In addition, the path board 33 is formed so that it may incline toward the bottom of peripheral wall of cover board 32, as shown in FIG. 5.

Near the bottom of path board 33 which is inclined downward, a long and slender belt 34 for conveying coins is arranged rotatably. Near the bottom of the peripheral wall of cover board 32, the long and slender belt 34 for conveying coins is arranged rotatably. This conveying belt 34 is made from rubber or the like and many grooves are formed on the upper surface of this conveying belt 34 (not shown). This provides a friction surface.

The friction surface is inclined to be in one plane with the inclined surface of path board 33. The path board 33 is formed of metal. This is shown in FIG. 5. Coin C on the path board 33 will slide down, and will contact with the perimeter surface of cover board 32.

A coin in contact with the perimeter surface of cover board 32 will be conveyed clockwise by the conveying belt 34 (see FIG. 1). In addition, the conveying belt 34 is provided with the outer edge 39 of a fairly large ring body 37 of plain shape (see FIG. 4). This ring body 37 is rotatably arranged along the internal circumferential surface of cover body 32.

Rollers 40 are pivoted on the large ring body 37 at equal intervals (refer FIG. 4), and are rotatably arranged on the base board 31 with a center at the center of base board 31.

Figure 3:
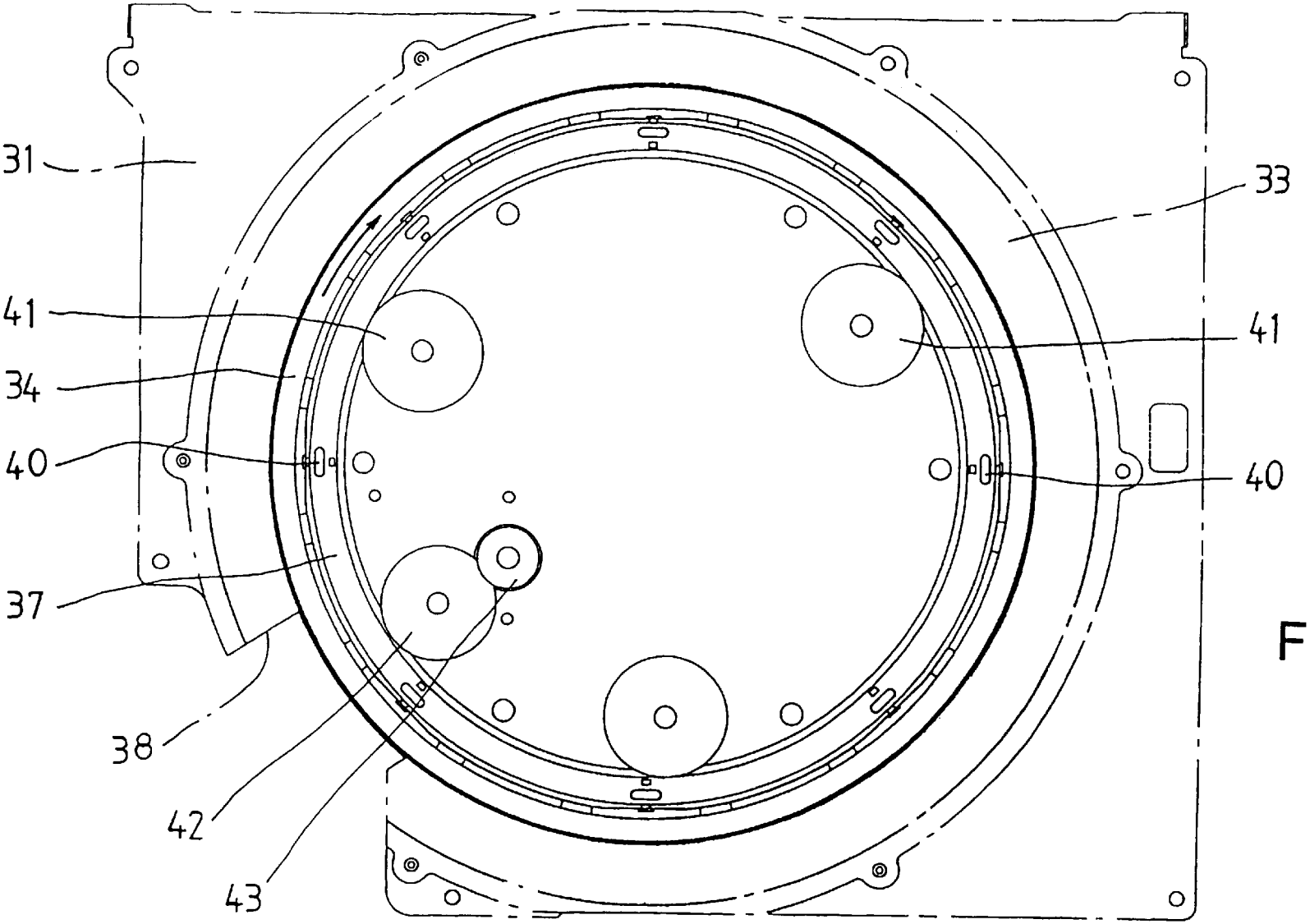
FIG. 3 is a schematic plan view showing a drive device of the embodiment of FIG. 1.

Internal teeth are formed on the internal-circumference surface of ring body 37, and are meshed with three gears 41 pivoted on the base board 31 (see FIG. 3). The rotation of ring body 37 is guided by the gears 41 at three support points.

Furthermore, a gear 42 which meshes with the internal teeth of ring body 37 is pivoted by the base board 31. The gear 42 has geared with a drive gear 43 which penetrates the base board 31.

This drive gear 43 is rotated by an electric motor (not shown) of a thick plate shape which is secured to the undersurface of base board 31.

Moreover, an alignment/discrimination apparatus for coins (see FIG. 2) is mounted at the notch 38 of angular part of distribution apparatus for coins as shown in FIG. 1. By the alignment/discrimination apparatus, coins are aligned and distinguished one by one to be supplied to the path board 33. The coin supplied to the path board 33 is conveyed clockwise by the belt 34.

The coin alignment/discrimination apparatus is explained as follows:

The apparatus has first means (11, 12, etc.) for putting a plurality of thrown coin in a row. A hopper for coin injection 11 is shown in Fig, along with a low speed belt 12 and a reverse-rotation roller 15 for preventing overlap of two coins. The apparatus is provided with means (16, etc.) for separating a plurality of coins in a row to separate every piece. A high-speed belt 16 is used. Means (18, etc.) for distinguishing the one separated coin is used. This is a sensor 18 for discriminating coins. Furthermore, the apparatus is provided with means (21, etc.) for receiving the genuine coin when the separated coin is genuine. A selection roller of coins 21 is provided. A solenoid 24 is used for operating the selection roller.

Figure 2:
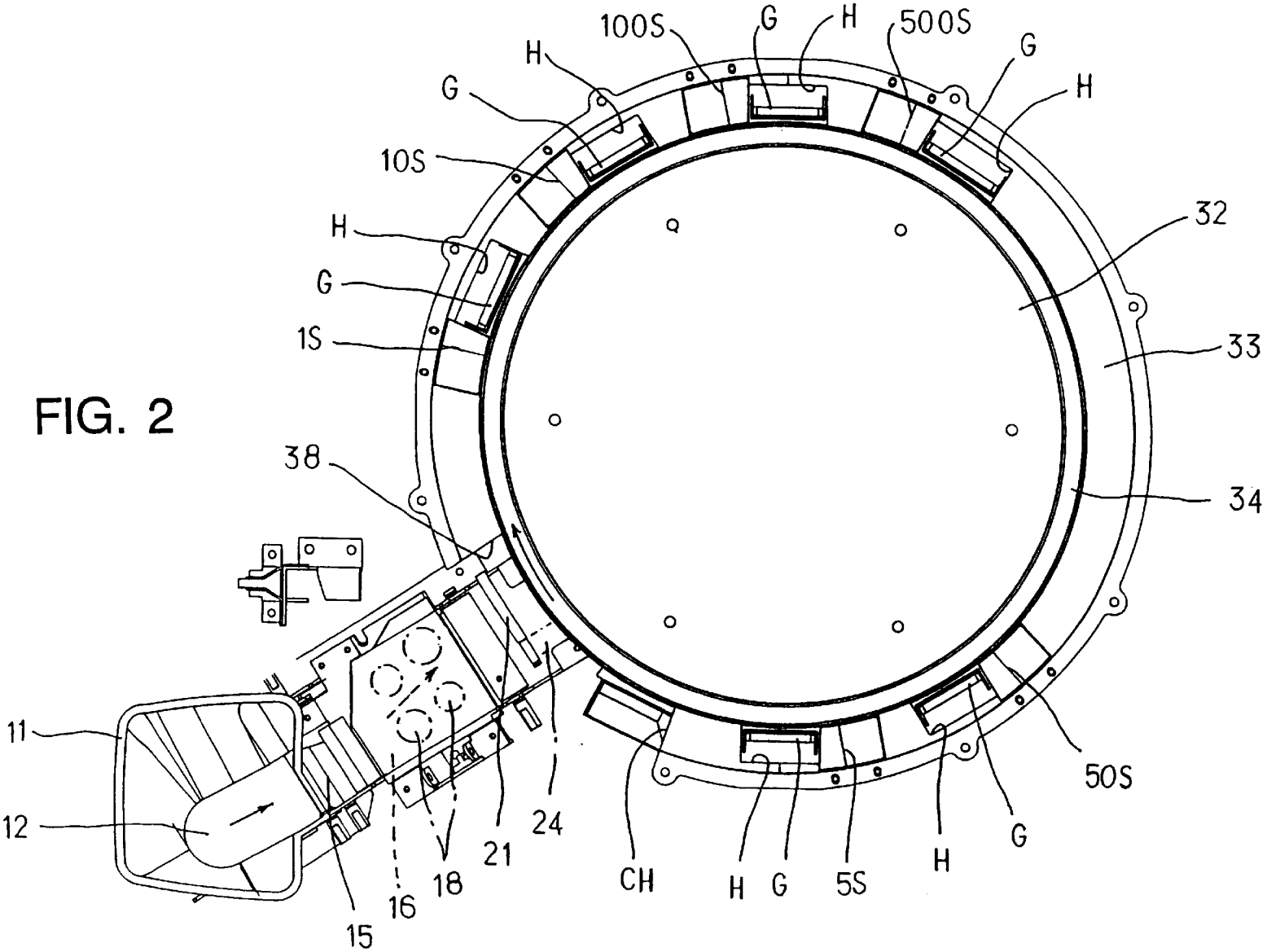
FIG. 2 is a schematic plan view showing a service condition of the embodiment of FIG. 1.
Figure 4:
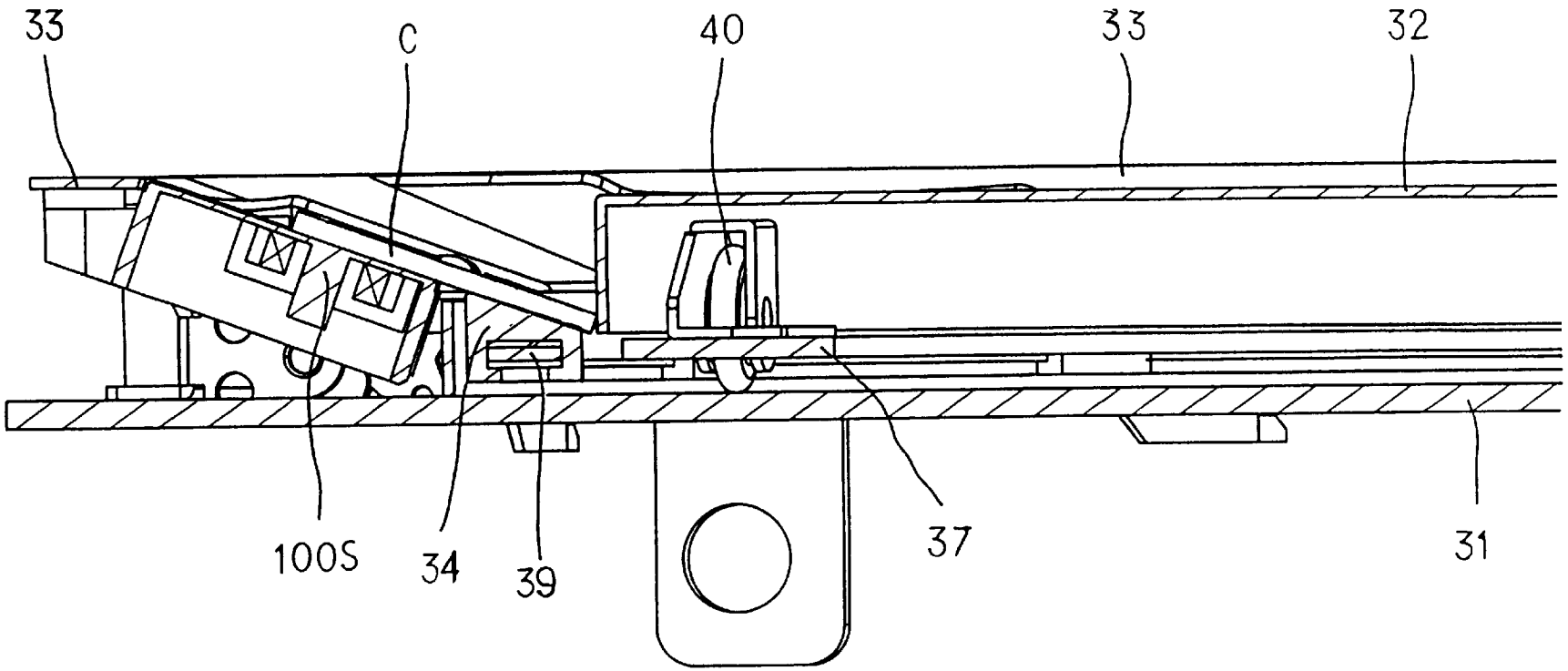
FIG. 4 is an expanded sectional view showing the principal part of the embodiment of FIG. 1 from the front.

Sensor 1S is shown in the path board 33 on the left side of FIG. 2. This sensor 1S is for detecting a coin. The sensor 1S is a magnetic sensor, for example, and if a certain coin (e.g. 1 Yen) is detected, the sensor will output a signal. Sensor 10S near the sensor IS detects another coin (e.g. 10 Yen) similarly. Sensor 100S shown in the path board 33 of the upper side of FIG. 2 detects another coin (e.g. 100 Yen). A sensor 500S near the sensor 100S detects the another coin (e.g. 500 Yen) similarly. Symbol 5S shown in the path board 33 of the lower part of FIG. 2 is a sensor for detecting another coin (e.g. sensor 5S will output a signal if a 5 Yen coin is detected). A sensor 50S near the sensor 5S detects another coin (e.g. a 50 Yen coin) similarly. In addition, the upper surfaces of each sensor 1S–500S are arranged—to be coincident with the upper-surface level of the path board 33 as shown in FIG. 4. In other words, each sensor is arranged so that coins can pass smoothly over the ring shape path board 33.

FIG. 2 shows, on the path board 33 of the down-stream side of each sensor 1S–500S, an oblong open-hole H through which each coin can drop respectively. Further, these oblong open-holes H are respectively formed of the same shape. Still, an opening CH which is provided at the most downstream of path board 33 is formed in order to store coins, or cancel coins. And near the inside edge in each oblong open-hole H, a long and slender gate G is pivotably openable, respectively (see FIG. 2). In addition, the gate G is specifically a long and slender roller which is rotatably arranged. Moreover, the upper surface of each gate G is arranged to be coincident with the upper-surface level of path board 33 as shown in FIG. 5. That is, each gate G is arranged so that the coin can pass the ring shape path board 33 smoothly.

As shown in FIG. 5 and on the base board 31 near the outside edge in each open-hole H, a solenoid SL is fixed respectively. Each solenoid SL operates the gate G by the signal from the sensor 1S–500S and opens the open-hole H, respectively (refer FIG. 6). In addition, as not shown, the solenoid SL for each coin of the various different types (e.g. 1 Yen, 10 Yen, 500 Yen, 50 Yen, and 5 Yen) is similarly fixed to the base board 31, respectively.

As shown in FIG. 1, a coin C is conveyed on the path board 33 by the belt 34. If the conveyed coin C is for example 100 Yen, the sensor 100S will detect the coin C (refer FIG. 4).

Figure 6:
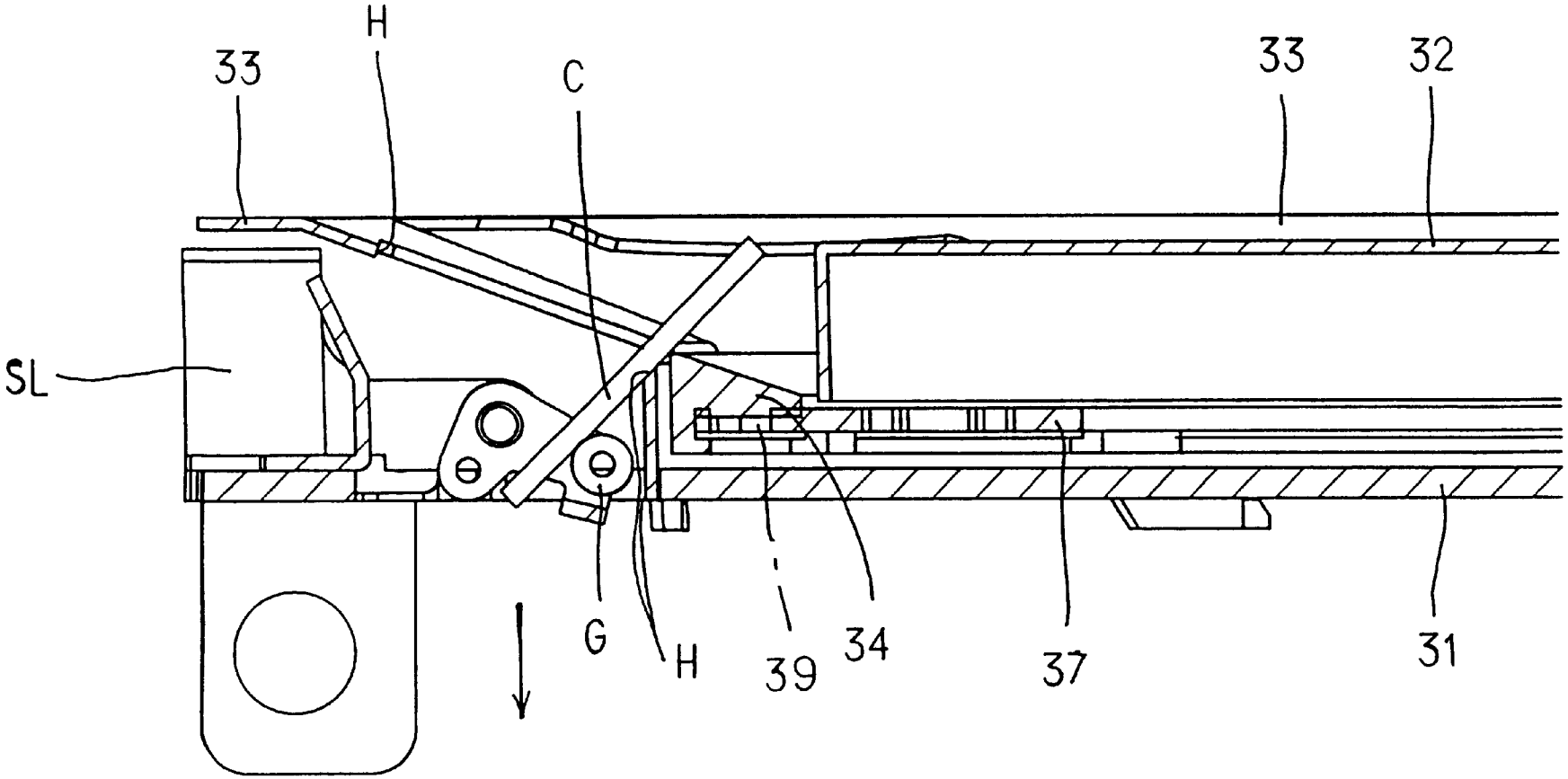
FIG. 6 is a sectional view showing an operation condition of FIG. 5.

If the sensor 100S detects the coin C of a particular type (e.g. 100 Yen), a current will flow into the solenoid SL, the gate G will be operated, and the openable hole H will be opened (see FIG. 6). Thus, the coin C (e.g. 100 Yen) will drop into the openable hole H due to its weight. The base board 31 also is provided with an openable hole H corresponding to the hole H, and coin C (e.g. 100 Yen) which is dropped is contained in a hopper apparatus.

On the other hand, for example, when a 500 Yen coin C is conveyed, the coin C passes the sensor 100. In this case, as the sensor 100 will not detect the 500 Yen coin C and a current does not flow to the solenoid SL. Therefore, as shown in FIG. 5, the gate G will stay closed and the openable hole H will stay closed and the 500 Yen coin C will pass the openable hole H.

Each coin of 6 different types (i.e., 1 Yen, 10 Yen, 100 Yen, 500 Yen, 50 Yen, and 5 Yen) can be distributed according to the money classification. In addition, if an openable hole H is increased on the right-hand side of path board 33 in FIG. 2, a coin distribution apparatus for 7 types of money or 8 types money will and be provided. Moreover, when coin discrimination signals from the coin alignment/discrimination apparatus (see FIG. 2 lower left) are processed statistically, the confirmation of the above-mentioned coin distribution may be obtained more exactly.

Figure 7:
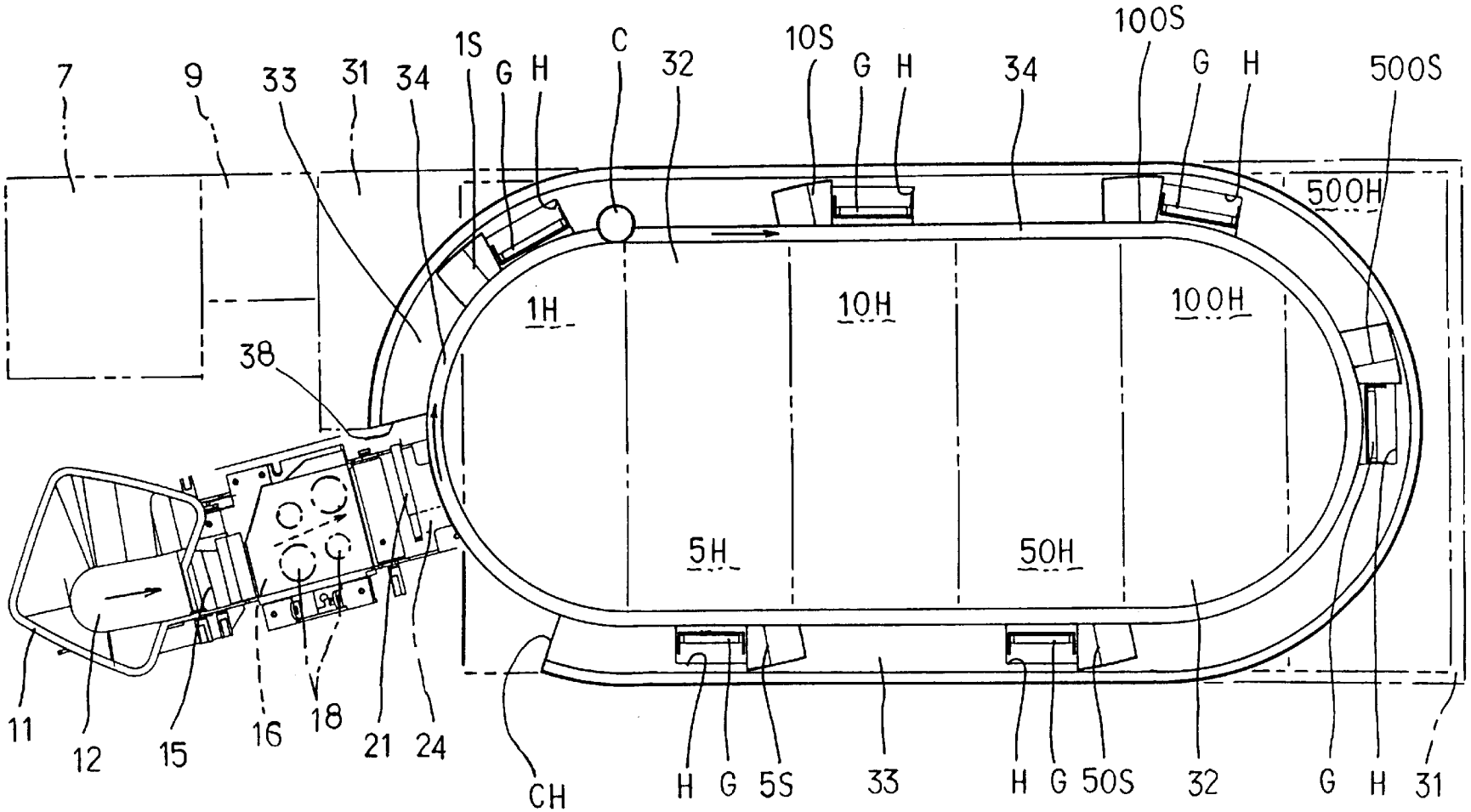
FIG. 7 is a schematic plan showing another embodiment of the invention.

Equipment for dividing a plurality of coins into the species/types according to another embodiment is equipped with a big rough rectangular base board 31, as shown in FIG. 7. On approximately the whole of base board 31, a little small and low height oval cover board 32 is fixed by screws and so on. At the outskirts of oval cover board 32, an approximately oval ringshaped passage board 33 is fixed on the base board 31 by screws or similar structure. Further, the passage board 33 is formed to incline toward the peripheral bottom wall of cover board 32 (see similar arrangement shown in FIG. 4). Near the bottom of passage board 33 which is inclined below, a slender belt 34 for coin conveyance is rotatably mounted. Near the peripheral bottom wall of cover board 32, the slender belt 34 for coin conveyance is rotatably provided. This belt 34 for conveyance is made from rubber or the like. Numerous grooves or surface irregularities (not shown) are formed on the surface thereof to form a frictional surface. The frictional surface is inclined to become identical approximately to the inclination of passage board 33 made from metal (see FIG. 5). Therefore, the coin on the passage board 33 slips and touches the surface around the cover board 32 (see similar structure sown in FIG. 4).

Figure 9:
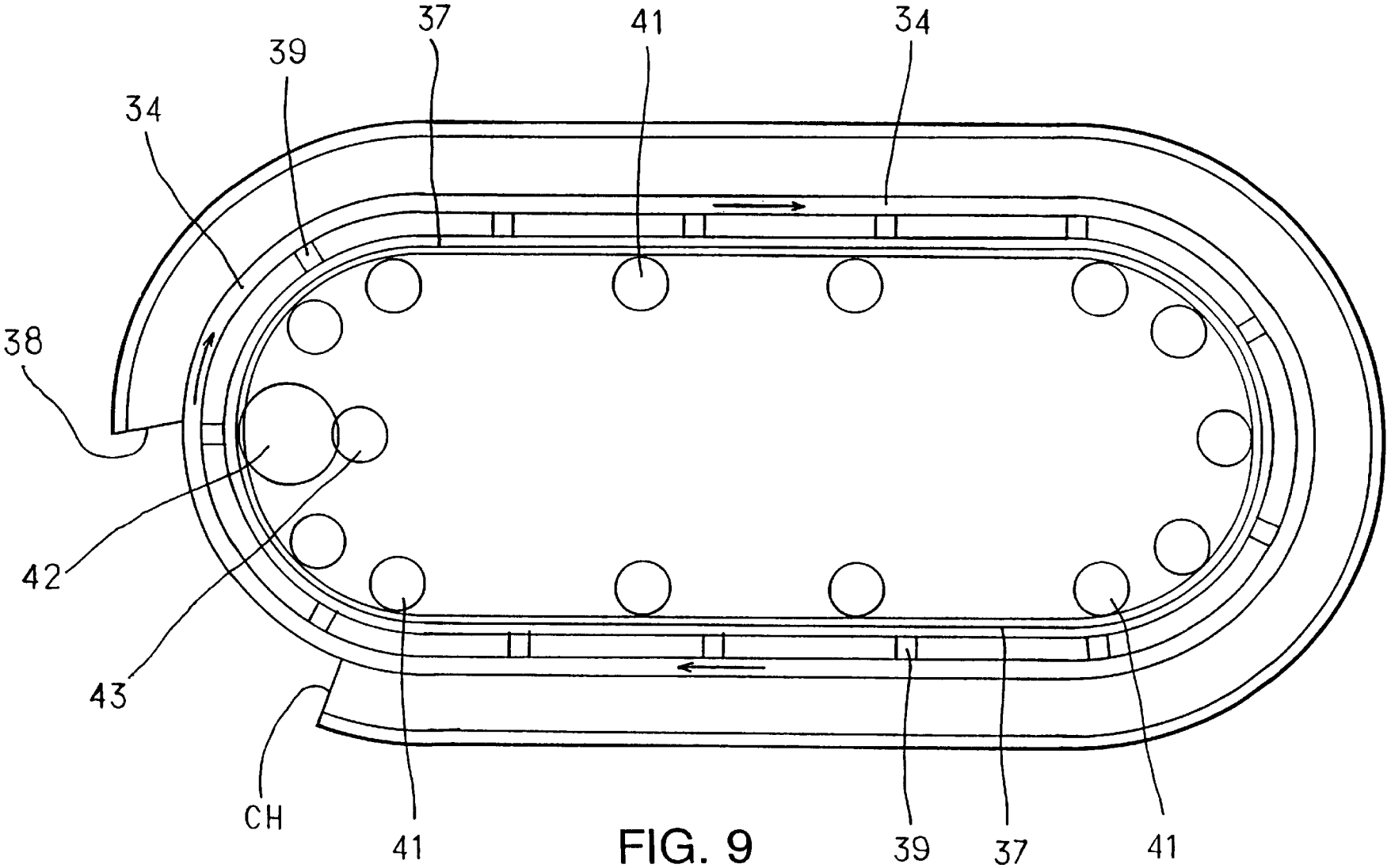
FIG. 9 is a schematic plan view to show the driving device of the embodiment of FIG. 7.
Figure 10:
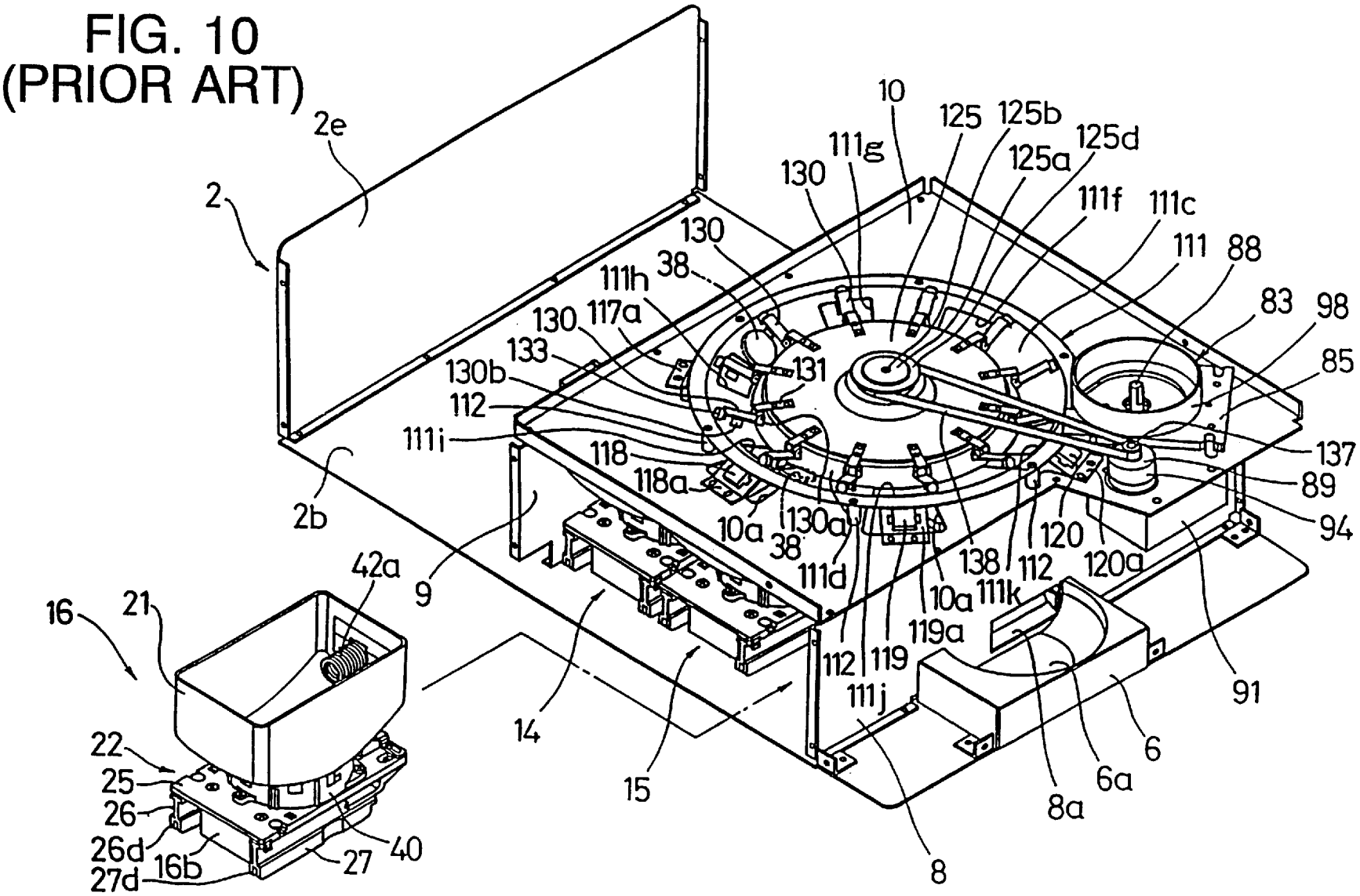
FIG. 10 (PRIOR ART)
FIG. 10 is a perspective view showing features from the known device discussed above.

A coin C which touches the surface around the cover board 32 is conveyed in the clockwise direction by the friction of belt 34 for conveyance (see FIG. 7). Further, the belt 34 for conveyance is attached to protrusions 39 of a big oval ring body 37 (see FIG. 9). This ring body 37 has flexibility and is formed of synthetic resin. That is, the section of ring body 37 is formed at vertical length and the whole ring body 37 can be curved. At the underside of ring body 37, a multiplicity of little long protrusions 39 are fixed directed outwardly. Moreover, the tip of these protrusions 39 is formed in square ring shape, for example. The rubber belt 34 is attached to the ring body 37 with the tip ring parts of protrusions 39 intervening. In addition, the ring body 37 is rotatably mounted along the internal circumference surface of cover body 32.

Small rollers 40 are pivoted at regular intervals in the big ring body 37 (see similar structure of FIG. 4). The ring body 37 is positioned on the surface of base board 31 and is also turnably provided along the internal circumference surface of oval cover body 32. An internal gear is formed along the whole internal circumference surface of ring body 37. A little big gear 42 which meshes with the in teeth of ring body 37 is pivoted at the base board 31 (see FIG. 9). On the other hand, the whole ring body 37 is guided by a multiplicity of small rollers 41 which were pivoted at the base board 31. The rotation of oval ring body 37 is guided by a plurality of rollers 41. Incidentally, the said gear 42 meshes with a drive gear 43 which is extended through the base board 31. This drive gear 43 is rotated by an electric motor (not shown) of plank form which was fixed at the underside of base board 31. Also, in the cut of protrusion 39 at the lower left of passage board 33 which is shown in FIG. 7, equipment for coin alignment and distinction is mounted.

The equipment for coin alignment and distinction is explained below.

The alignment and distinction equipment has means (11, etc ) to arrange a plurality of thrown coins into one line. Coins are aligned and distinguished one by one and further are supplied to the passage board 33 (see FIG. 7 and FIG. 2). The coin which was supplied to the passage board 33 is conveyed in the clockwise direction by the belt 34.

A sensor 1S for coin detection is shown in the left side of passage board 33. The sensor 1S is a magnetic sensor, for example, and outputs a signal when it detects a certain coin (e.g. 1 Yen). In the same way, a sensor 10S which is shown in the passage board 33 at the center of upper side in FIG. 7 detects another coin (e.g. 10 Yen). Sensor 100S which is shown in the passage board 33 at the right side on FIG. 7 detects another coin (e.g. 100 Yen). In the same way, a sensor 500S which is shown in the passage board 33 in the right side of FIG. 7 detects another coin (e.g. 500 Yen).

A sensor 50S which is shown in the passage board 33 at the lower side right on FIG. 7 is also a sensor for coin detection. When the sensor 50S detects a specific coin (e.g. a 50 yen coin) it outputs a signal. In the same way, a sensor 5S which is shown at the lower side left of passage board 33 detects still another coin (e.g. a 5 yen coin).

The surface levels of each sensor 1S–500S are arranged to be the same as the surface level of passage board 33 approximately (see the similar arrangement in FIG. 4). Each of sensors 1S–500S are arranged such that the coin is able to pass the oval ring-shaped passage board 33 smoothly. Then, as shown in FIG. 7, in the passage board 33 at the downstream side of each sensor 1S–500S, oblong holes H through which each species or type of coin falls are formed respectively. The oblong holes H are formed into approximately the same shapes, respectively. An opening CH in the most downstream of passage board 33 is formed to collect or cancel coins.

Near the inside edge of each oblong hole H, a slender gate G is pivoted to freely open and shut the hole H, respectively. The gate G is a spindly roller securely mounted and is provided rotatably. A surface level of each gate G is arranged to become the surface level of passage board 33 approximately (see similar structure of FIG. 5). That is, each gate G is arranged for the coin to be able to pass the oval shaped passage board 33 smoothly.

As shown in FIG. 5, a solenoid SL is fixed on the base board 31 near the outside edge of hole H, respectively. Each gate G is operated by means of each solenoid SL and each signal from the sensors 1S–500S and thus each hole H is opened (see FIG. 6). As not shown in the drawings and in the same way, solenoids SL for each coin of e.g. 1 Yen, 10 Yen, 500 Yen, 50 Yen, 5 Yen are fixed on the base board 31, respectively.

Each of hopper equipment 1H–500H are formed in the same structural manner. For illustration purposes, the hopper equipment 100H for a coin (e.g. a 100 Yen coin) is explained below with reference to FIG. 8.

When a head-stood electric motor 115 is driven, a disk 141 is turned in the direction of the arrow by means of gears (not shown) and a turn axis 126. As the result, a plurality of coins (e.g. 100 Yen coins) in a square pan-shaped hopper 145 are paid out one by one into an outlet 137 with a disk 141. When the electric motor 115 rotates the coin falls into either of the pierced holes 142 of disk 141 which is turned. The coin that is most below that has fallen into the pierced hole 142 slides on the surface of plate 133 which is made from metal, by means of a nail 143 with the turn of disk 141. The coin slides on the surface of plate 133 and is guided to the direction of outlet 137 with the wall of hopper 145 and a guide fragment 136. The coin which was guided to the direction of outlet 137 is pressed out from the position of pierced hole 142 by the nail 143 and one pair of pins (not shown). The coin which was pressed outside slips further out by nail 143, resisting each spring (not shown) of one pair of rollers 139. The slipping coin passes a sensor 108 and is thrown out on a belt 9 (see FIG. 8) for carrying it out. The coin which was thrown out on the belt 9 for carrying it is carried to a box 7 for change (see FIG. 7) by the concerned belt. Further, the coin which was pressed out and slipped from the hopper equipment 100H is electronically detected, when it passes the sensor 108. Therefore, the sensor 108 is used for the calculation of the coins which are released from the hopper equipment 100H.

Figure 8:
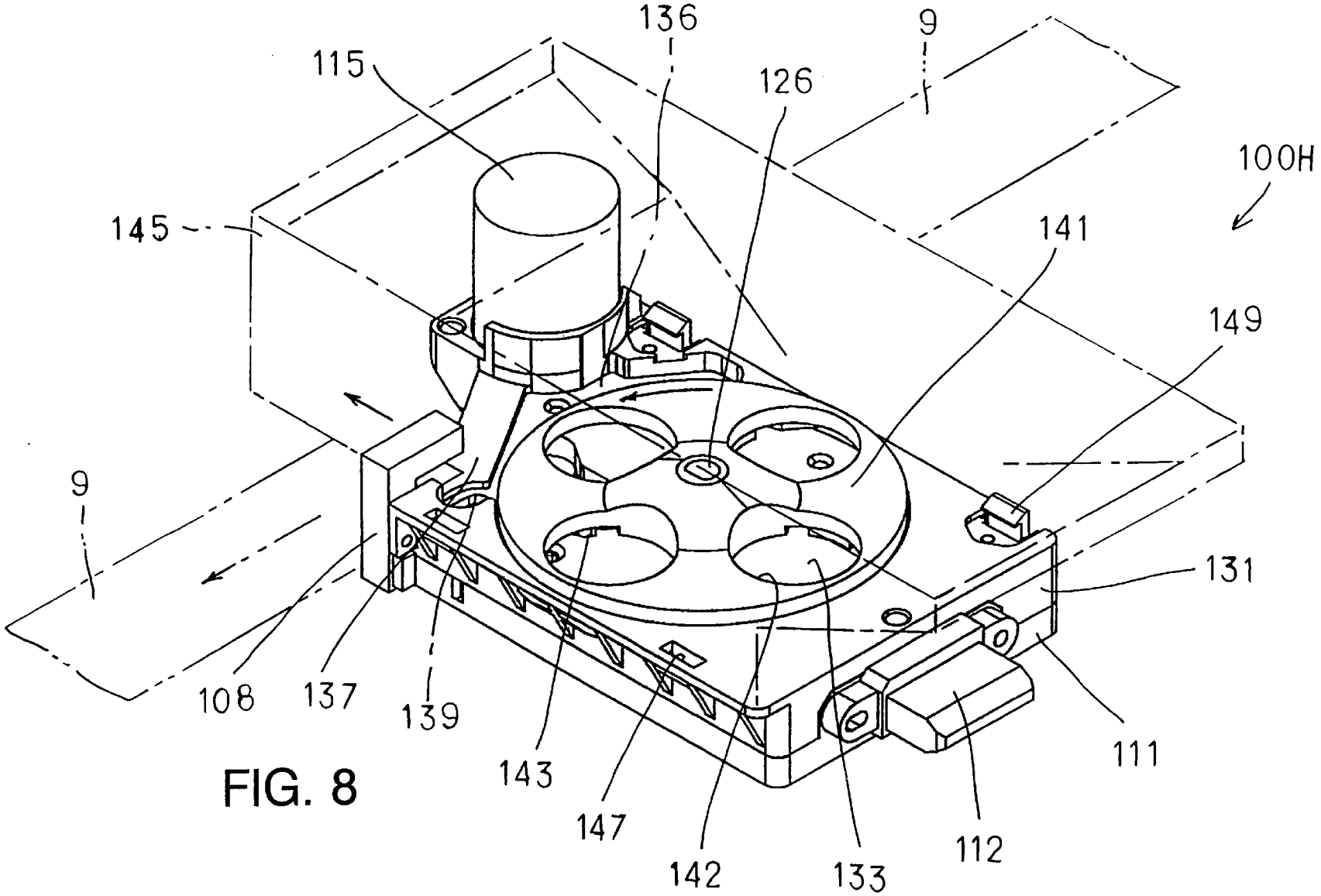
FIG. 8 is a schematic perspective showing a hopper equipment which is used for the embodiment of FIG. 7.

Electric connector 112 is shown in the lower right of FIG. 8. Also, a gear train (not shown) is stored between a bottom board 111 and a base board 131. Nails or latches 149 which were formed on the base board 131 bite into hollows (not shown) which are formed on the hopper 145, using springs (not shown). Hand hooks (not shown) which are formed on the lower edge of hopper 146 are inserted into small holes 147 of base board 131 without being extracted. In this way, the hopper 145 is fixed on the base board 131. Each hopper 1H–500H is made of about the same size. However hoppers for coins which have a lower frequency of use (e.g. 5 Yen, 50 Yen, 500 Yen) may be smaller.

According to this invention, since coins can be conveyed only by the long and slender conveying belt, the distribution apparatus can be simplified extremely. Furthermore, according to this invention, since the coin detector means and opening-closing means for coin receiving openable holes are arranged under the surface of the coin path, the height of entire apparatus can be low. The distribution apparatus according to this invention can secure the height which can be easily housed under various apparatuses. In addition, since this invention has a simple structure, it has the advantage that the maintenance becomes extremely simple. Furthermore, according to this invention the distribution of many types of money can be obtained, and there is a large effect that the distribution order of money type can be made as desired.

While specific embodiments of the invention have been shown and described in detail to illustrate the application of the principles of the invention, it will be understood that the invention may be embodied otherwise without departing from such principles.

What is claimed is:

1. Equipment for dividing a plurality of coins, comprising:

a cover with a low big circular board form;

a slender ring for coin conveyance, which is rotatably mounted along an outside periphery of a bottom of said cover; and a coin passage device with an approximately ring-shaped inclination board, an outside perimeter of said inclination board being higher than an inside perimeter and said inside perimeter being near an outside periphery of said ring, said coin passage device having a plurality of openings for coin division.

2. The equipment for dividing a plurality of coins according to claim 1, further comprising means to open and shut one of said openings for coin division.

3. The equipment for dividing a plurality of coins according to claim 2, said means further having means for detecting a diameter of coins.

4. An apparatus for distributing coins into the coin kinds, comprising:

a cover of a disc type with a low height;

a slender belt for coin conveyance which is rotatably arranged along an outside periphery of a bottom of said cover; and a coin path device with a plurality of open holes for coin distribution, the path device having an inclination board of substantial ring shape with an outside periphery which is higher than an inside periphery, said inside periphery approaching an outside periphery of said belt.

5. The apparatus for distributing coins into coin kinds according to claim 4, further comprising an opening device for opening-closing one of said open holes for coin distribution, said opening device being arranged at an undersurface of said open hole.

6. The apparatus for distributing coins into coin kinds according to claim 5, wherein said opening device is actuated by means for detecting coins.

7. Equipment for dividing coins into the coin species, comprising:

a cover with low height and big oval board form;

a slender belt for coin conveyance which is provided turnably along an outside perimeter of a bottom of said cover;

a passage for coins including an inclined board with substantially an oval ring shape and with an outside perimeter which is higher than an inside perimeter and said inside perimeter approaches an outside of said belt, a plurality of openings for coin division provided at said passage.

8. The equipment for dividing coins into the species according to claim 7, further comprising opening means for opening and shutting openings for coin division, said opening means being provided on an underside of said openings.

9. The equipment for dividing coins' into the species according to claim 7, wherein said means for opening and shutting said openings is actuated by a means for detecting a type of coin.

* * * * *